US012005496B2

(12) United States Patent
Dechassey et al.

(10) Patent No.: US 12,005,496 B2
(45) Date of Patent: Jun. 11, 2024

(54) NOTCHED INGOT IMPROVING A LINE PRODUCTIVITY

(71) Applicant: ArcelorMittal, Luxembourg (LU)

(72) Inventors: Emmanuel Dechassey, Godella Valencia (ES); Woudhouh Memni, Thionville (FR); Patrice Vicente-Hernandez, El Puig Valencia (ES)

(73) Assignee: ArcelorMittal, Luxembourg (LU)

( * ) Notice: Subject to any disclaimer, the term of this patent is extended or adjusted under 35 U.S.C. 154(b) by 210 days.

(21) Appl. No.: 17/610,791

(22) PCT Filed: May 13, 2020

(86) PCT No.: PCT/IB2020/054538

§ 371 (c)(1),
(2) Date: Nov. 12, 2021

(87) PCT Pub. No.: WO2020/230058

PCT Pub. Date: Nov. 19, 2020

(65) Prior Publication Data

US 2022/0314308 A1 Oct. 6, 2022

(30) Foreign Application Priority Data

May 13, 2019 (WO) ..... PCT/IB2019/053932

(51) Int. Cl.
*B22D 7/00* (2006.01)
*B22D 5/00* (2006.01)
(Continued)

(52) U.S. Cl.
CPC ..... *B22D 7/005* (2013.01); *B22D 5/005* (2013.01); *B22D 7/00* (2013.01); *B22D 7/06* (2013.01);
(Continued)

(58) Field of Classification Search
CPC . B22D 7/005; B22D 7/06; B22D 7/00; B22D 5/005; B22D 25/00; B22D 25/02;
(Continued)

(56) References Cited

U.S. PATENT DOCUMENTS 3,385,678 A 5/1968 Sorensson
4,148,394 A 4/1979 Bederman
2010/0163592 A1* 7/2010 DeClark ..... B23D 31/002 225/2

FOREIGN PATENT DOCUMENTS

CN 101092670 A 12/2007
CN 201150977 Y 11/2008
(Continued)

OTHER PUBLICATIONS

See Search Report of PCT/IB2020/054538 dated Jul. 21, 2020.
(Continued)

*Primary Examiner* — Michael E. La Villa
(74) *Attorney, Agent, or Firm* — Davidson Kappel LLC

(57) ABSTRACT

A rectangular parallelepiped ingot defined by a height H, a width W and a length L, having longitudinal faces extending between two end faces, having a volume between 0.15 $m^3$ and 0.80 $m^3$ and a surface area to volume ratio between 10 $m^{-1}$ and 18 $m^{-1}$, made of at least one metal, including at least one notch and a notch tip along the ingot length, wherein the at least one notch is configured such that: MaxD<H/2, MaxD<W/2 and MaxD being the maximum distance between any point of the ingot and the closest surface of the ingot.

19 Claims, 5 Drawing Sheets

(51) Int. Cl.

| | |
|---|---|
| ***B22D 7/06*** | (2006.01) |
| ***B22D 25/00*** | (2006.01) |
| ***B22D 25/02*** | (2006.01) |
| ***C23C 2/00*** | (2006.01) |
| ***C23C 2/04*** | (2006.01) |

(52) U.S. Cl.
CPC ..... *B22D 25/00* (2013.01); *B22D 25/02* (2013.01); *C23C 2/0034* (2022.08); *C23C 2/04* (2013.01); *C23C 2/50* (2022.08); *C23C 2/54* (2022.08); *Y10T 428/12222* (2015.01); *Y10T 428/12229* (2015.01); *Y10T 428/12354* (2015.01); *Y10T 428/12361* (2015.01); *Y10T 428/12396* (2015.01)

(58) Field of Classification Search
CPC ..... C23C 2/04; C23C 2/50; C23C 2/0034; C23C 2/54; Y10T 428/12222; Y10T 428/12229; Y10T 428/12354; Y10T 428/12361; Y10T 428/12396
See application file for complete search history.

(56) References Cited

FOREIGN PATENT DOCUMENTS

| | | | |
|---|---|---|---|
| CN | 101745626 | A | 6/2010 |
| CN | 205650781 | U | 10/2016 |
| FR | 2678185 | A1 | 12/1992 |
| JP | 2016026876 | A | 2/2016 |
| RU | 2066583 | C1 | 9/1996 |
| SU | 1321508 | A1 | 7/1987 |
| SU | 1400765 | A1 | 6/1988 |
| SU | 1694322 | A1 | 12/1991 |
| TW | M568856 | U | 10/2018 |
| WO | WO 2020230021 | A1 | 11/2020 |

OTHER PUBLICATIONS

Written opinion for PCT/IB2020/054538.
Mark Simpson, "Zinc Alloy Unibar Ingot", Allied Metal Company, (Jan. 19, 2018).

* cited by examiner

NOTCHED INGOT IMPROVING A LINE PRODUCTIVITY

The present invention relates to a metallic ingot permitting to reduce the formation of dross and to increase a coating line productivity by improving its melting rate and easing the line management while keeping satisfactory mechanical properties of the ingot.

BACKGROUND

Nowadays, most of the metallic products are coated to enhance their properties, especially their surface properties. Such coatings are generally alloys primarily based on aluminium and/or zinc. As represented in FIG. 1, one of the most common coating processes is the hot-dip, wherein the product to be coated 1 (eg.: a band, a strip or a wire) is dipped into a bath of molten metal 2, contained in a tank 3, which will adhere to the product surface and then form a desired coating. Said product is generally continuously passed through the bath by means of conveying means and an immerged roll 4.

Furthermore, because the product leaves the bath with a coating layer, the bath level decreases if not supplied in coating material. Consequently, the bath should be fed regularly to maintain or at least regulate the bath level at a desired level. This feeding can be done through ingot addition wherein an ingot 5 is introduced into the bath 2 at a controlled rate using an insert table 6 and a holding or inserting mean 7.

SUMMARY OF THE INVENTION

As more of the product exits the bath, more coating is deposited, and more molten metal leaves the bath. The more rapidly the product leaves the bath, the more rapidly the bath level decreases. So, for a higher coating line productivity, the required feeding rate is higher in order to maintain the bath at a desired level.

The ingot supply into the bath is commonly, but not necessarily, done in three steps. Firstly, the ingot is handled from a storage location to an introduction position, where the ingot is usually hold held by a holder 6 and positioned on an insert table 5. Secondly, the ingot is introduced little by little into the bath 2 until the ingot portion 8 where the ingot is held melts. At that moment, the non-melted portion of the ingot, usually the core, falls to the tank bottom. Even though the ingot is introduced step by step, it is not completely melted at the end of the second step except in rare case such as for low productivities. Thirdly, the ingot at the tank bottom melts.

During the ingot melting, its shape will evolve into different shapes, represented in FIG. 2 by modelled ingot shapes A to D. Only a half of an ingot is modelled because a symmetrical behaviour is expected for the other half, said half is along the ingot length. The shape A represented the ingot shape at the end of the step 2, when the ingot is completely immersed. The shapes B to D represent ingot shapes after a determined complete immersion time in the molten metal bath: B: 10 min-C: 20 min-D: 25 min. This sequence and the calculated ingot are calculated for an ingot having a length of 2150 mm, a solidus temperature of 575° C., a liquidus temperature of 601° C., during a feeding process in a molten metal bath of 650° C. made of the following steps:

1) A first sequence of immersion: 4 s immersion of 30 mm+25 s maintain,

2) Repeat said sequence 71 times to completely immerse the ingot (end of step 2 corresponds to A in FIG. 2), 3) Maintain the whole ingot immersed and wait for its complete melting (B, C and D in FIG. 2).

As modelled and represented in FIG. 2, an ingot fed during an industrial sequence can take more than 30 min to completely melt so one or several ingots can be present and/or pile at the tank bottom. Of course, said melting time depends on the sequence of immersion, the ingot and bath properties and the process condition. For example, the thermal bath properties depend on the bath composition, e.g. for a zinc-based bath, the temperature is generally around 470° C. and for an Alusi-based bath, the bath temperature is around 650° C.

However, the presence of one or several ingots at the bottom of the tank leads to several drawbacks for the coating quality because it generates a so called "cold point" in the bath leading, among other things, to dross formation. Moreover, if there are too many ingots at the tank bottom, they may pile and enter in contact with the product to be coated leading to catastrophic consequence for the strip quality and the coating installation.

Consequently, to reduce the formation of dross and to increase a coating line productivity, the ingot pile formation must be reduced or hindered.

It is an object of the present invention to provide a solution solving the aforementioned problems.

The present invention provides a rectangular parallelepiped ingot (9) defined by a height H, a width W and a length L, having longitudinal faces (11*a*) extending between two end faces (11*b*), having a volume between 0.15 $m^3$ and 0.80 $m^3$ and a surface area to volume ratio between 10 $m^{-1}$ and 18 $m^{-1}$, made of at least one metal, comprising at least one notch (10) and a notch tip (12) along said ingot length, wherein said at least one notch (10) is configured such that:

MaxD<H/2,

MaxD<W/2 and

MaxD being the maximum distance between any point of said ingot and the closest surface of said ingot.

The present invention also provides a process for managing a bath level of a molten alloy and preventing dross formation inside a tank wherein an ingot, as described above, is fully immersed into said bath.

BRIEF DESCRIPTION OF THE DRAWINGS

Other characteristics and advantages of the invention will become apparent from the following detailed description of the invention.

To illustrate the invention, various embodiments and trials of non-limiting examples will be described, particularly with reference to the following figures.

DETAILED DESCRIPTION

Figure 3:
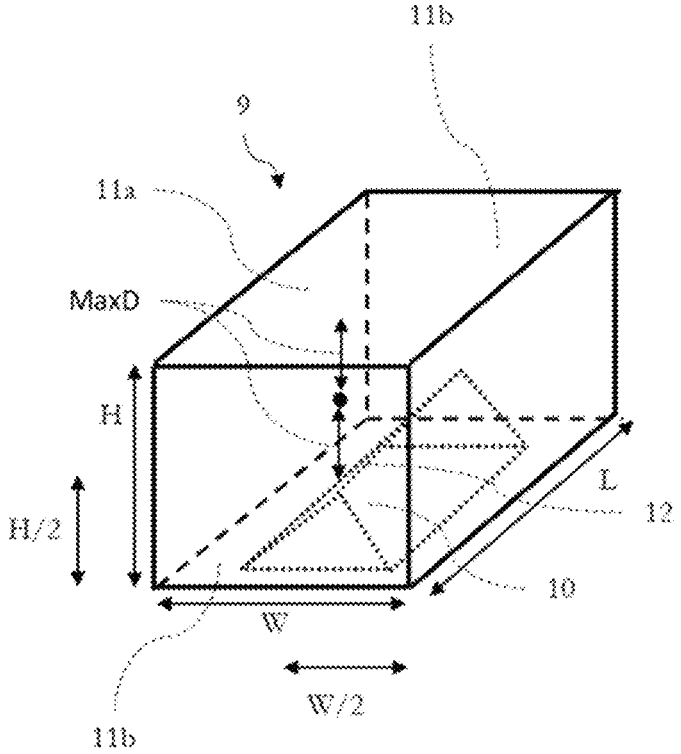
FIG. 3 is a schematic view of an embodiment of the present invention.
Figure 4:
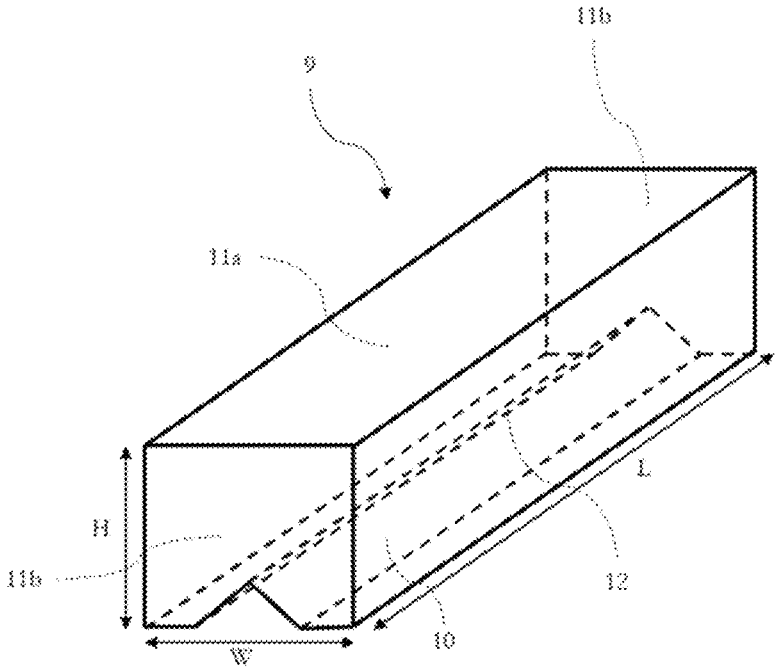
FIG. 4 is a schematic view of a second embodiment of the present invention.

As illustrated in FIGS. 3 and 4, the invention relates a rectangular parallelepiped ingot 9 defined by a height H, a width W and a length L, having longitudinal faces 11*a* extending between two end faces 11*b*, having a volume between 0.15 $m^3$ and 0.80 $m^3$ and a surface area to volume ratio between 10 $m^{-1}$ and 18 $m^{-1}$, made of at least one metal, comprising at least one notch 10 and a notch tip 12 along said ingot length, wherein said at least one notch 10 is configured such that:

MaxD<H/2,

MaxD<W/2 and

MaxD being the maximum distance between any point of said ingot and the closest surface of said ingot.

The length L is bigger than the height and the width. In the case where the ingot cannot be clearly defined by a length, a width and a height, for example an egg or pyramidal form, the projection of such ingot on a surface can be used to define a width and a height.

Figure 5:
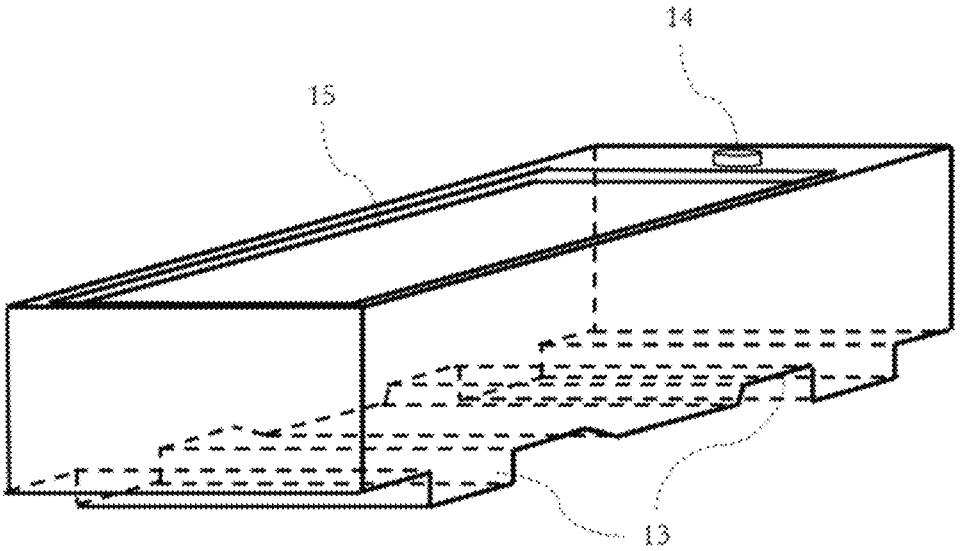
FIG. 5 is a schematic view of an embodiment of a parallelepipedal ingot as understood in the present invention.

The ingot is described as parallelepipedal, but, as represented in FIG. 5, the term "parallelepipedal" includes crenellations 13, attachment means 14, any rim or edges 15 and/or any common ingot geometry. Such crenellations are used for handling purpose solely, e.g.: for elevating the ingot. Moreover, the ingot shape, a parallelepiped is commonly used and would thus need only minor or no change to the supplying system to be industrially implemented. Furthermore, because it does not contain any protuberance nor fragile edges or sections, which might break during the ingot handling and/or addition, the claimed ingot is choc resistant and thus industrially suitable The ingot has a volume between 0.15 $m^3$ and 0.80 $m^3$. On one hand, if the ingot volume exceeds 0.80 $m^3$, the ingot might be difficult to transport, stock, handle and/or used by the supplying mean of the coating line. On the other hand, if the ingot volume is lower than 0.15 $m^3$, the productivity might be negatively impacted because the time taken to handle and place the ingot on the supplying mean will be too high compared to the ingot melting time.

The ingot has a surface area to volume ratio between 10 $m^{-1}$ and 18 $m^{-1}$. On one side, if this ratio is lower than 10 $m^{-1}$, it lowers the melting rate of the ingot due to a low exchange surface between the ingot and the molten metal bath which negatively impacts the line productivity and the bath management due to the risk of ingot pile formation at the tank bottom. On the other side, if this ratio exceeds 18 $m^{-1}$, considering the claimed ingot, it would apparently weaken the choc resistance of the ingot and thus increase the ingot breakage risk.

Figure 6:
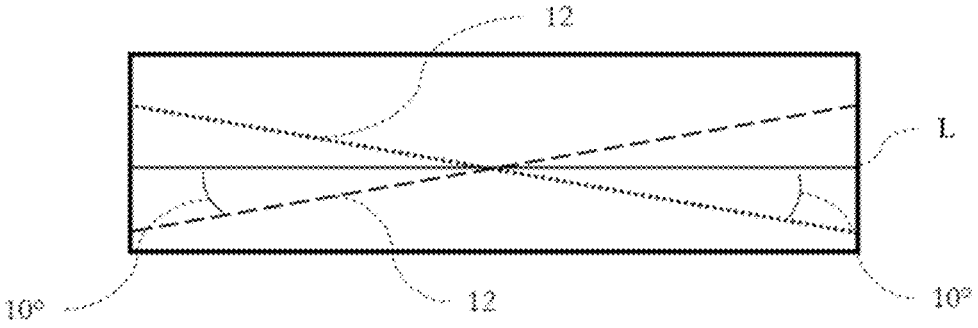
FIG. 6 exhibits what is understood by the terms "along said ingot length".

As illustrated in FIG. 6, the term along said ingot length includes a deviation of 1°, 2°, 3°, 4°, 5°, 6°, 9°, 8°, 9° or 10° of the notch tip (12) to the ingot length.

Figure 1:
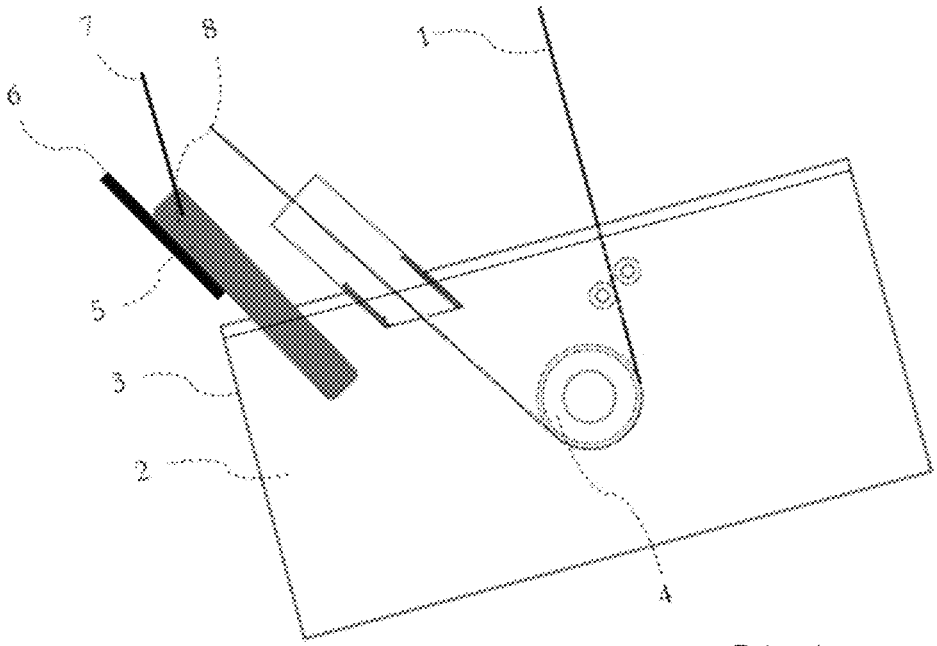
Prior Art Figure 1
FIG. 1 is a schematic view of a classical coating installation.
Figure 2:
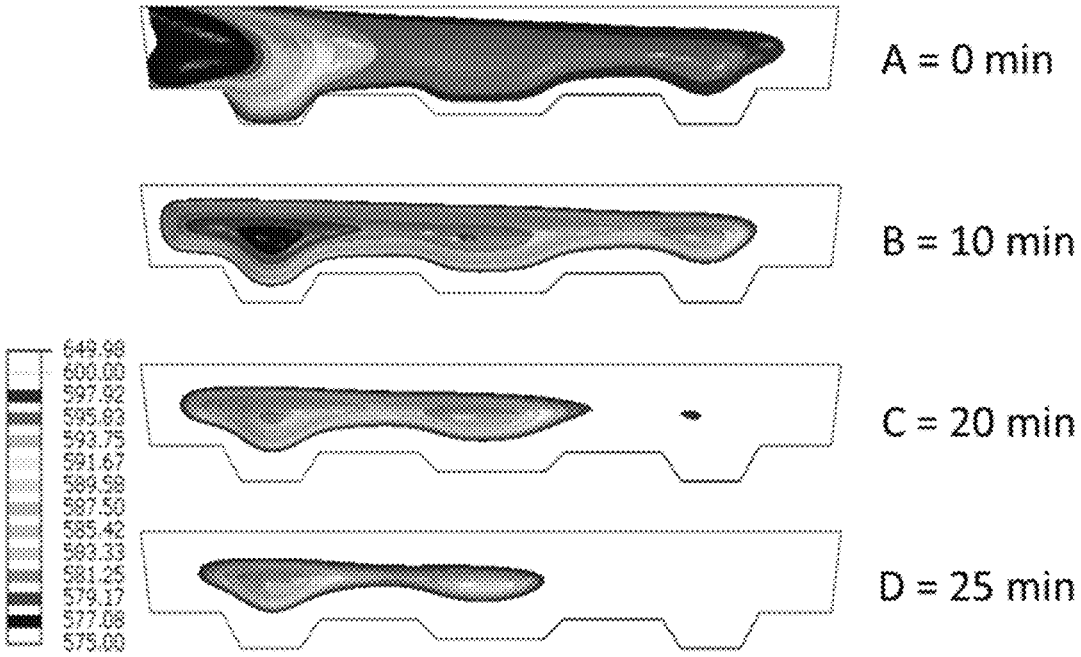
FIG. 2 exhibits several modelled ingot shapes during an ingot feeding process in determined industrial process condition for an embodiment of a classical ingot at determined melting times.
Figure 7:
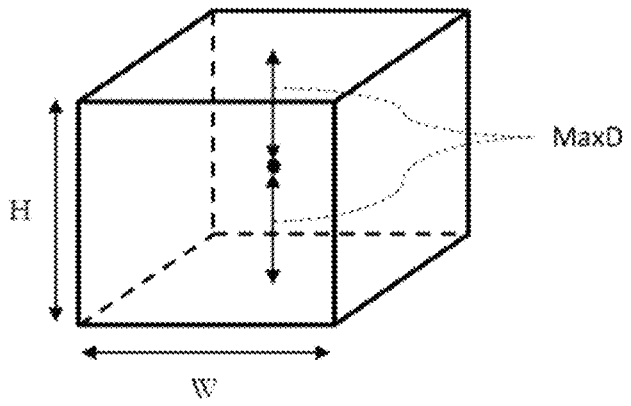
FIG. 7 is a schematic view of an embodiment of an ingot as known in the state of the art.
Figure 8:
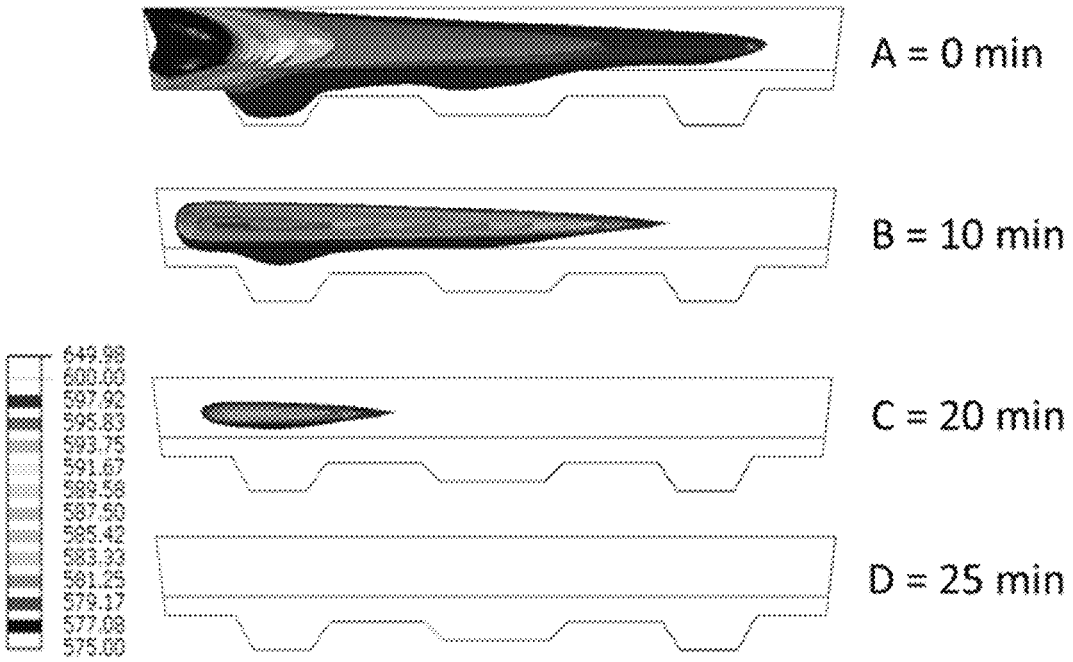
FIG. 8 exhibits several modelled ingot shapes during an ingot feeding process in determined industrial process condition for an embodiment of the present invention at determined melting times.

Driven by the idea of reducing the ingot melting time and the ingot pile formation, an ingot comprising a notch is particularly interesting for two reasons. Firstly, compared to a classical ingot, an ingot according to the invention, as represented in FIG. 3, permits to reduce MaxD to a value smaller than H/2 and W/2. So during the claimed ingot melting, the molten metal bath will melt more rapidly the point at a distance MaxD from the ingot surface because it is at a smaller distance from the molten metal bath, i.e. the heat source, compared to a parallelepipedal ingot as illustrated in FIG. 7. In FIG. 8, the ingot melting is modelled for the same condition as in the FIG. 1. The time noted, from 0 to 25 min, is the time during which the ingot is completely immersed. Secondly, said claimed ingot is easy to cast, even from existing mould where only a part should be added inside the mould to have a desired notch.

Figure 9:
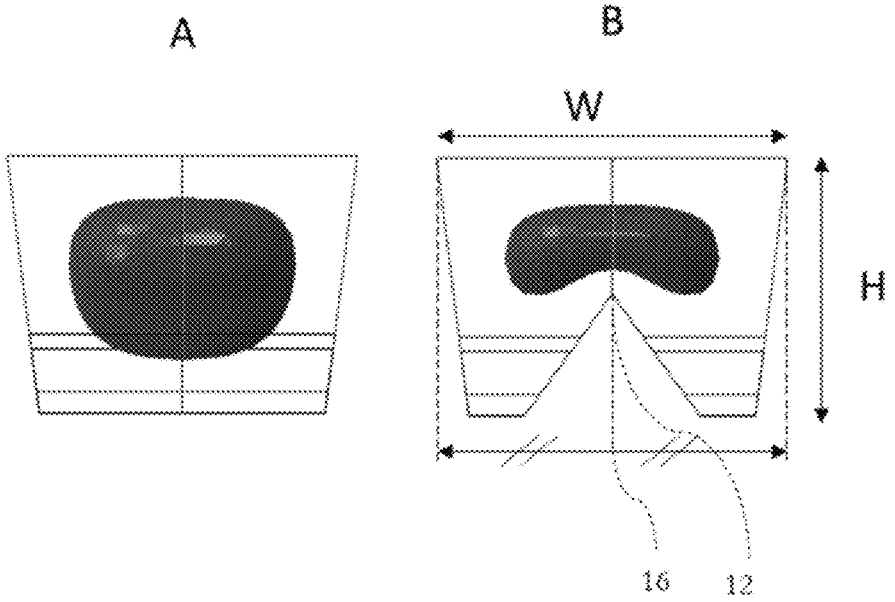
FIG. 9 exhibits the melting shapes of a classical ingot and an embodiment of an ingot of the present invention.

Consequently, the melting speed of the ingot is hence increased which reduce the formation of ingots pile at the bottom of said tank. FIG. 9 exhibits the impact of the increased melting between a classical ingot A and an embodiment of the claimed invention B by showing rear views of said ingots.

The claimed ingot comprises a notch, the term "notch" means an indentation on an ingot surface and/or as a V-shaped cut in a hard surface. Said indentation can also be of any shape such as spherical, parallelepipedal, pyramidal. For example, said indentation can be comprised on only one face as illustrated in FIG. 3, extend from one face to its opposed face as illustrated in FIG. 4. For instance, it can have a V-shape or have a pyramidal shape.

The claimed ingot is made of at least one metal. Preferably, the ingot is at least made of zinc and/or silicon and/or magnesium and/or aluminium.

Preferably, said at least one notch 10 extends from a first face of the ingot to a second face of the ingot being the opposite face of said first face. During the melting, once the ingot is at the tank bottom, such a notch eases the separation of the ingot into two ingots reducing the formation of ingots pile at the tank bottom for two reasons. Firstly, due to the ingot separation, the melting speed is increased because a greater exchange surface is available between the metal molten bath and the ingots. Secondly, thanks to smaller ingots, the pile formed will be smaller.

Preferably, as illustrated in FIG. 4, said at least one notch 10 extends from a first end face of the ingot to a second end face of the ingot being the opposite face of said first end face of the ingot.

Preferably, said ingot has a surface area to volume ratio between 12 $m^{-1}$ and 18 $m^{-1}$. Such a ratio range increases even further the productivity because the lower threshold is increased compared to the previous mentioned range.

Preferably, said ingot has a volume between 0.15 $m^3$ and 0.40 $m^3$.

Figure 10:
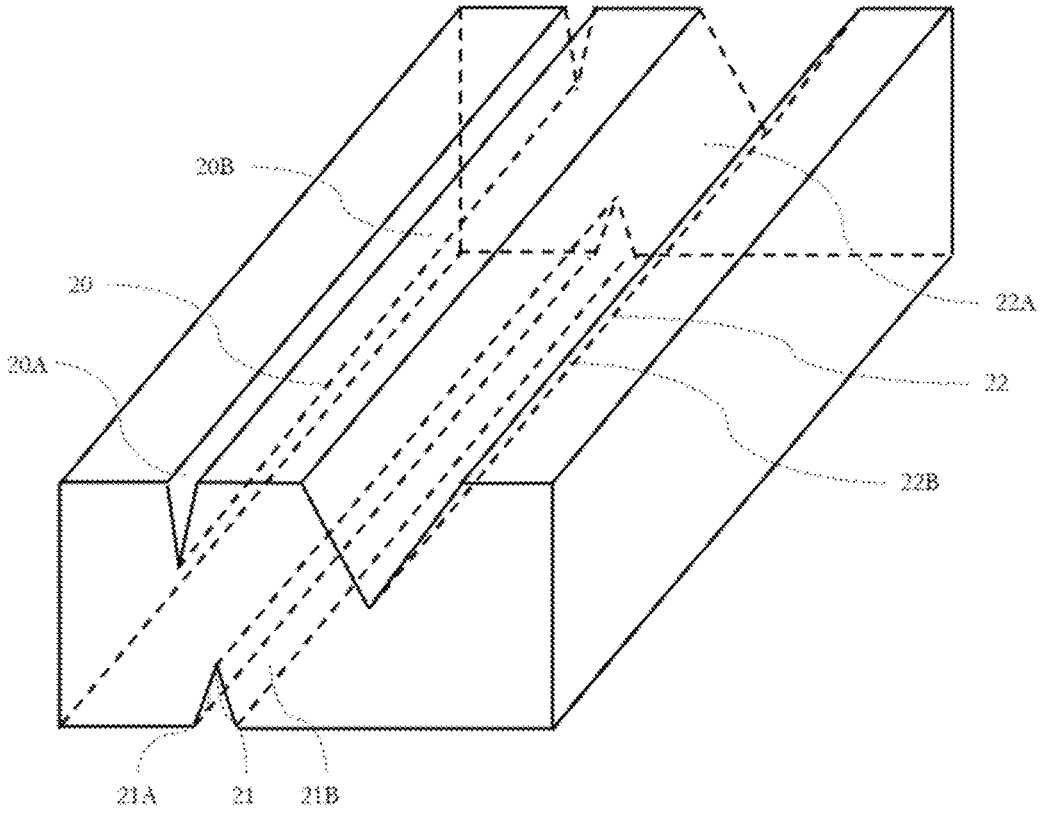
FIG. 10 is a schematic view of an embodiment of the present invention exhibiting preferred angles between the notch faces.

Preferably, said at least one notch (20, 21, 22) comprises at least two faces (20A and 20B, 21A and 21B, 22A and 22B) facing each other, said two faces forming an angle comprised between 10° and 90°. As illustrated in FIG. 10, the schemed ingot comprises three notches (20, 21 and 22), each of them having two faces (respectively 20A, 20B, 21A, 21B, 22A and 22B). Each notch has a defined angle between its two faces: 20°, 35° and 60° for the notches 19, 21 and 22. On one hand, apparently, if the angle is higher than 10°, the molten metal bath flows more easily along said notch tip 12 leading to a higher heat exchange and thus increasing the melting rate along the notch tip. On the other hand, apparently, if the angle is higher than 90°, the melting rate increases compared to the volume loss become less advantageous in view of the supplying rate, notably due to the handling time of the ingot.

Preferably, said at least one notch (20, 21, 22) comprises at least two faces (20A and 20B, 21A and 21B, 22A and 22B) facing each other, said two faces forming an angle comprised between 20° and 50°. Apparently, this range is optimal in view of the melting rate increase compared to the volume loss.

Preferably, said at least one notch has a maximum depth of three quarters of the ingot width W and/or height H. Apparently, when the notch depth is greater than those values, it lowers the choc resistance and the robustness of the ingot thus increasing the risk of negative drawbacks, such as breakage, when handling said ingot.

Preferably, said at least one notch has a depth at least a quarter of the ingot width W and/or height H and the ratio between said ingot width W and said ingot H being comprised between 0.75 and 1.33.

Preferably, said at least one notch has a depth at least a third of the ingot width W and/or height H and the ratio between said ingot width W and said ingot H being comprised between 0.66 and 1.5.

Preferably, said at least one notch has a depth of at least a half of the ingot width W and/or height H and the ratio between said ingot width W and said ingot H being comprised between 0.50 and 2.

Preferably, said notch tip is positioned between a quarter and three quarters of the ingot width W or of the ingot height H.

Even more preferably, said notch tip is positioned at half width of the ingot or half height of the ingot. Such a notch configuration is apparently advantageous because upon melting, the ingot can be separated into two pieces, depending on the notch depth and position, of approximately the same size which will melt at a quasi-similar rate. The period at which no more ingot is present is reduced compared to a case where the ingot separates into two pieces of different size, e.g.: a big piece and a smaller piece. This participates in the formation reduction of ingot pile and consequently eases the molten metal bath management.

The positioning of the notch tip at half width is illustrated in FIG. 9, wherein it can be observed that the projection 16 of the notch tip on the ingot width is at half width, on the middle of the width W.

The invention also refers to a process for managing a bath level of a molten alloy and preventing dross formation inside a tank wherein an ingot, according to anyone of claims 1 to 12, is fully immersed into said bath.

The invention claimed is:

1. A rectangular parallelepiped ingot defined by a height H, a width W and a length L, having longitudinal faces extending in a length direction between two end faces, the ingot comprising:

a volume between 0.15 $m^3$ and 0.80 $m^3$ and a surface area to volume ratio between 10 $m^{-1}$ and 18 $m^{-1}$, made of at least one metal; and at least one notch having a notch tip along one of the longitudinal faces, the at least one notch being configured such that:

MaxD<H/2,

MaxD<W/2 and

MaxD being a maximum distance between any point of the ingot and a closest surface of the ingot.

2. The ingot as recited in claim 1 wherein the at least one notch extends on one of the longitudinal faces from a first face of the ingot to a second face of the ingot being the opposite face of said first face.

3. The ingot as recited in claim 1 wherein the two ends faces include a first end face opposite a second end face and the at least one notch extends from the first end face to the second end face.

4. The ingot as recited in claim 1 wherein the volume is between 0.15 $m^3$ and 0.40 $m^3$.

5. The ingot as recited in claim 1 wherein the at least one notch includes two notch faces facing each other, the two notch faces forming an angle of 10° to 90°.

6. The ingot as recited in claim 5 wherein the two notch faces form an angle of 20° to 50°.

7. The ingot as recited in claim 1 wherein the one of the longitudinal face is defined by the ingot width W and length L, and at least one notch has a maximum depth of three quarters of the ingot height H.

8. The ingot as recited in claim 1 wherein the one of the longitudinal faces is defined by the ingot width W and length L, and the at least one notch has a depth at least a quarter of the ingot height H and a ratio between the ingot width W and the ingot height H is from 0.75 to 1.33.

9. The ingot as recited in claim 1 wherein the one of the longitudinal faces is defined by the ingot width W and length L, and the at least one notch has a depth at least a third of the ingot height H and a ratio between the ingot width W and the ingot height H if from 0.66 to 1.5.

10. The ingot as recited in claim 1 wherein the one of the longitudinal faces is defined by the ingot width W and length L, and the at least one notch has a depth of at least a half of the ingot or height H and a ratio between the ingot width W and the ingot height H is from 0.50 to 2.

11. The ingot as recited in claim 1 wherein the one of the longitudinal faces is defined by the ingot width W and length L, and the notch tip is positioned between a quarter and three quarters of the ingot height H.

12. The ingot as recited in claim 1 wherein the one of the longitudinal faces is defined by the ingot width W and length L, and the notch tip is positioned at half height of the ingot.

13. The ingot as recited in claim 1 wherein the one of the longitudinal face is defined by the ingot height H and length L, and at least one notch has a maximum depth of three quarters of the ingot width W.

14. The ingot as recited in claim 1 wherein the one of the longitudinal faces is defined by the ingot height H and length L, and the at least one notch has a depth at least a quarter of the ingot width W and a ratio between the ingot width W and the ingot height H is from 0.75 to 1.33.

15. The ingot as recited in claim 1 wherein the one of the longitudinal faces is defined by the ingot height H and length L, and the at least one notch has a depth at least a third of the ingot width W and a ratio between the ingot width W and the ingot height H if from 0.66 to 1.5.

16. The ingot as recited in claim 1 wherein the one of the longitudinal faces is defined by the ingot height H and length L, and the at least one notch has a depth of at least a half of the ingot width W and a ratio between the ingot width W and the ingot height H is from 0.50 to 2.

17. The ingot as recited in claim 1 wherein the one of the longitudinal faces is defined by the ingot height H and length L, and the notch tip is positioned between a quarter and three quarters of the ingot width W.

18. The ingot as recited in claim 1 wherein the one of the longitudinal faces is defined by the ingot height H and length L, and the notch tip is positioned at half width of the ingot.

19. A method for managing a bath level of a molten alloy and preventing dross formation inside a tank comprising:

providing a bath of a molten alloy; and fully immersing the ingot as recited in claim 1 in said bath.

* * * * *